US006793570B1

(12) United States Patent
Wekstein

(10) Patent No.: US 6,793,570 B1
(45) Date of Patent: Sep. 21, 2004

(54) COIN DEPOSIT AND RETRIEVAL TRAY

(76) Inventor: Ted Wekstein, 48 Horseshoe Hill Rd., Pound Ridge, NY (US) 10576

( * ) Notice: Subject to any disclaimer, the term of this patent is extended or adjusted under 35 U.S.C. 154(b) by 101 days.

(21) Appl. No.: 10/289,730

(22) Filed: Nov. 7, 2002

(51) Int. Cl.[7] ..... G07D 3/00
(52) U.S. Cl. ..... 453/18; 446/11; 453/39
(58) Field of Search ..... 453/39, 18; 206/0.8, 206/0.81, 0.815; 193/DIG. 1; D20/10; D21/301, 310, 322

(56) References Cited

U.S. PATENT DOCUMENTS

| | | | | | |
|---|---|---|---|---|---|
| 407,713 | A | * | 7/1889 | Wilson | 273/120 R |
| 433,736 | A | * | 8/1890 | Lockwood | 446/8 |
| 4,297,807 | A | * | 11/1981 | Buettner | 446/11 |
| 4,475,564 | A | | 10/1984 | Koester et al. | |
| D285,859 | S | | 9/1986 | Ooki | |
| 4,762,512 | A | | 8/1988 | Divnick | |
| 4,871,055 | A | * | 10/1989 | Poythress et al. | 194/344 |
| D307,503 | S | | 4/1990 | Divnick | |
| D324,751 | S | | 3/1992 | Perkitny | |
| D378,464 | S | | 3/1997 | Perkitny | |
| 5,911,299 | A | * | 6/1999 | Aspnes et al. | 194/344 |
| D425,284 | S | | 5/2000 | Nottingham et al. | |
| D426,694 | S | | 6/2000 | Nottingham et al. | |
| D437,469 | S | | 2/2001 | Nottingham et al. | |
| 6,443,829 | B1 | | 9/2002 | Perkitny | |

FOREIGN PATENT DOCUMENTS

| | | | | |
|---|---|---|---|---|
| WO | WO 00/48136 A2 | * | 8/2000 | G07D/3/08 |

* cited by examiner

*Primary Examiner*—Donald P. Walsh
*Assistant Examiner*—Mark J Beauchaine
(74) *Attorney, Agent, or Firm*—DeLio & Peterson LLC; Peter W. Peterson

(57) ABSTRACT

A device for depositing and retrieving coins comprises a generally conical-shaped, upstanding body having an exterior tapering to a larger diameter from top to bottom and a header portion at the lop of the body for depositing the objects. A downwardly and outwardly spiraling ramp, below the header portion, extends at least once around the exterior of the body. The ramp cooperates with the exterior of the body on the inside and a lip on the outside to guide the objects as they roll downwardly by gravity. The ramp may include an upwardly extending portion at the lower end of the generally conical-shaped body for launching the objects through the air into the open tray, and/or a staircase portion on the spiraling ramp. A tray adjacent the bottom of the body receives the coins from the ramp.

20 Claims, 5 Drawing Sheets

20
30
22
26
50
23
62
60
23

30
32
34
56a
58
22
26
50
54
28
52
56c
40
56b
23
24
70

22
40
26
25
24

40
28
22
40
26
24

COIN DEPOSIT AND RETRIEVAL TRAY

BACKGROUND OF THE INVENTION

1. Field of the Invention

This invention relates to a device for depositing and retrieving disk-like objects such as coins.

2. Description of Related Art

Retail counter space is difficult to obtain, especially near the point of sale (POS), for example at a cash register, where customers make purchases and are open to last minute buying decisions. It is common for retail stores to charge manufacturers and/or distributors for retail shelf space. Product brand managers are especially cognizant of the value of having products and/or advertising located at a POS, particularly a product which is subject to snap decision making.

The ubiquitous "give a penny, take a penny" coin trays located at cash registers offer some opportunity for advertising. However, it has been found that consumers pay scant attention to such advertising, even when depositing and retrieving coins.

Bearing in mind the problems and deficiencies of the prior art, it is therefore an object of the present invention to provide a device for depositing and retrieving coins or other disk like objects which may be used at a store POS.

It is another object of the present invention to provide a coin deposit and retrieval device which includes surfaces available for advertising indicia.

A further object of the invention is to provide a coin deposit and retrieval device which engages the customer's attention for an extended time.

It is yet another object of the present invention to provide a coin deposit and retrieval device which provides interactivity with the customer.

Still other objects and advantages of the invention will in part be obvious and will in part be apparent from the specification.

SUMMARY OF THE INVENTION

The above and other objects, which will be apparent to those skilled in art, are achieved in the present invention which is directed to a device for depositing and retrieving coins or other disk-like objects comprising a generally conical-shaped, upstanding body having an exterior tapering to a larger diameter from top to bottom and a header portion at the top of the body for depositing the objects. A downwardly and outwardly spiraling ramp, below the header portion, extends at least once around the exterior of the body. The objects may roll downwardly by gravity along the ramp. The device further includes a tray adjacent the bottom of the body for receiving the objects from the ramp.

The ramp is adjacent the exterior of the body and cooperates therewith to guide the objects as they roll downwardly by gravity. The ramp includes a lip for guiding the objects as they roll downwardly by gravity, the ramp and the lip being integral with and formed by the exterior of the body. The ramp may include an upwardly extending portion at the lower end of the generally conical-shaped body for launching the objects through the air into the open tray, and/or a staircase portion on the spiraling ramp.

Preferably, the header portion has a surface against which the objects may be singly placed by hand, and an open slot having an open bottom below the surface through which the objects may fall by gravity onto the ramp near the top of the generally conical-shaped body after being released by the hand. The header portion may include a visible indicia on a surface thereof.

The tray is preferably disposed outward of the generally conical-shaped body and is an open tray from which the objects may be readily retrieved by hand. The device may also include a sensor for detecting when an object passes a position on the device.

There may be further included a storage rack disposed below the tray for displaying articles associated with the device. Alternatively, the tray includes a downwardly sloping portion and an opening at a lower end thereof, and the device further includes a receptacle below the tray opening, whereby objects received in the tray may travel downward by gravity through the opening and into the receptacle.

In another aspect, the present invention provides a method for depositing and retrieving coins or other disk like objects comprising providing a device having a generally conical-shaped, upstanding body with an exterior tapering to a larger diameter from top to bottom; a header portion at the top of the body for receiving the objects; a downwardly and outwardly spiraling ramp, below the header portion, extending at least once around the exterior of the body; and a tray adjacent the bottom of the body. The method then includes depositing an object by hand in the header portion; viewing the object as it rolls downwardly by gravity on the ramp around the exterior of the body and falls into the tray; and retrieving the object by hand after it has fallen into the tray.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
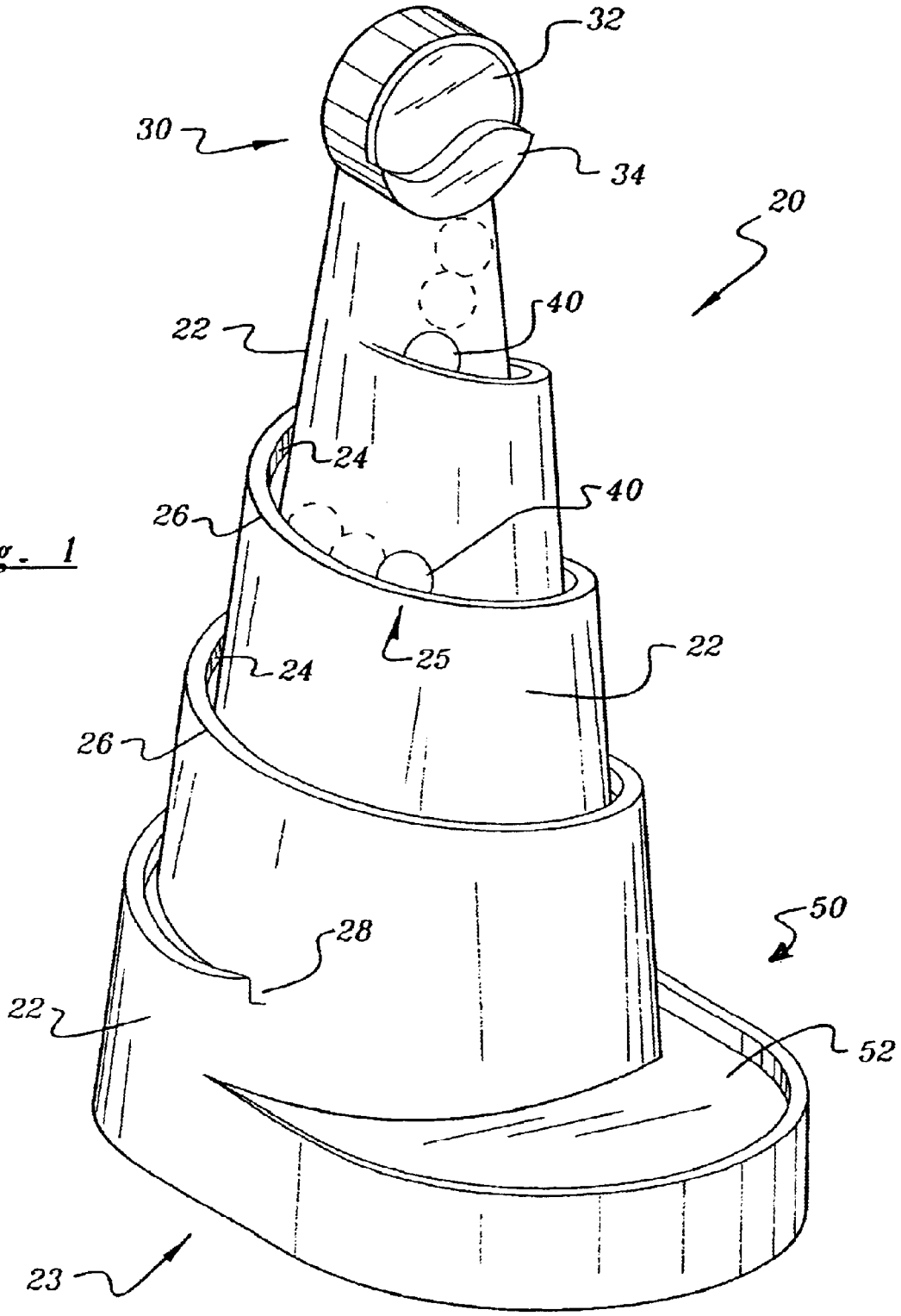
FIG. 1 is a perspective view of the preferred coin deposit and retrieval device of the present invention.
Figure 3:
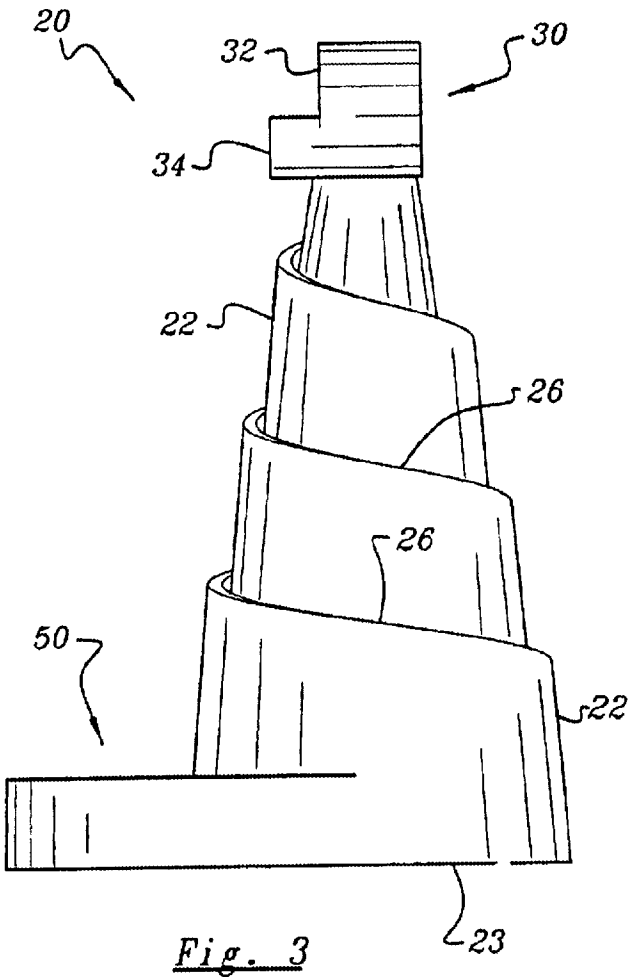
FIG. 3 is a left side elevational view of the device of FIG. 1.

In describing the preferred embodiment of the present invention, reference will be made herein to FIGS. 1–12 of the drawings in which like numerals refer to like features of the invention.

A preferred embodiment of the device for depositing and retrieving coins or other disk like objects is depicted in FIGS. 1–10. The device 20 is made of plastic or other suitably formable material and has a generally conical shaped, upstanding body portion 22, which tapers from a small diameter or width at the top to a larger diameter or width at the bottom. A header portion 30 is disposed at the top of the body portion 22, and functions to receive the coins deposited by the customer or other user of the device. For simplicity of description, the operation of the device will be described with reference to coins, although any other disk-like objects may be utilized in the present invention. Also, to the extent that the invention depicted in the drawings contains ornamental features, the configuration of the header 30 forms no part of the preferred ornamental design of the present invention.

Figure 2:
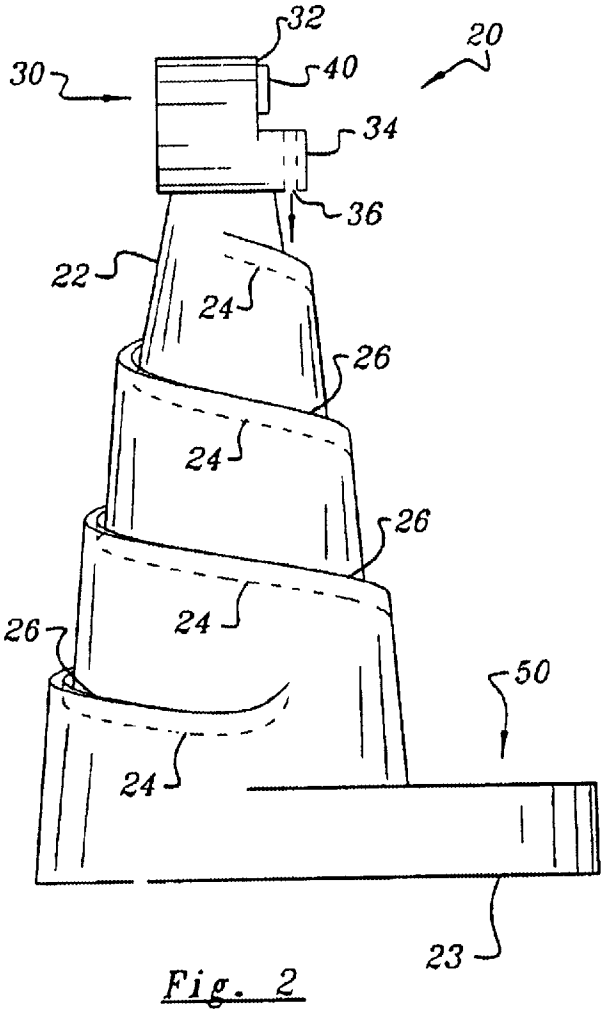
FIG. 2 is a right side elevational view of the device of FIG. 1.
Figure 5:
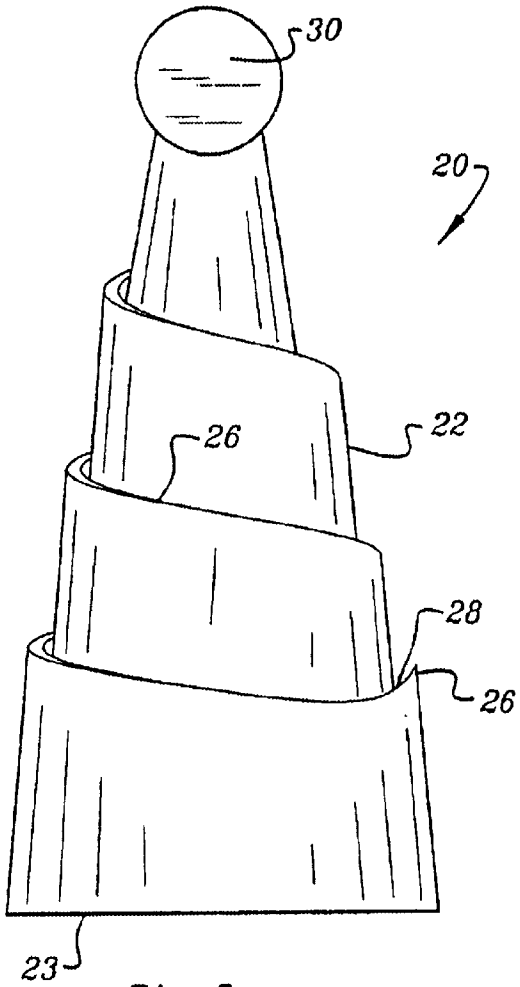
FIG. 5 is a rear elevational view of the device of FIG. 1.
Figure 4:
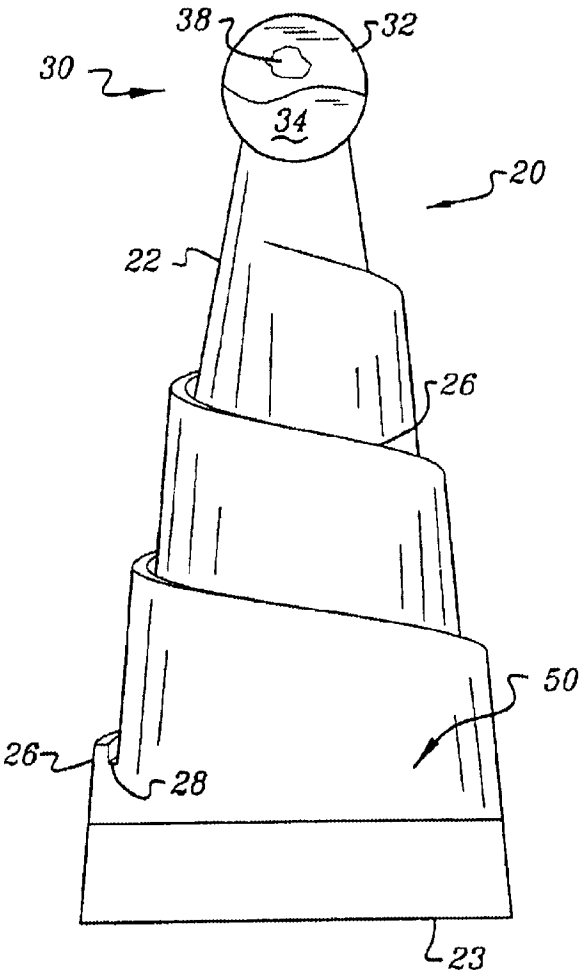
FIG. 4 is a front elevational view of the device of FIG. 1.

Header portion 30 preferably includes a frontward facing vertical face 32 upon which a coin 40 may be placed by the user's hand. Spaced outward from the lower front portion of surface 32 is header wall 34, positioned a sufficient distance such that, when released, coin 40 passes between surface 32 and wall 34, and out through a slot 36 at the lower end of the header portion 30 (FIG. 2).

Extending at least once, and preferably several times, around the exterior of body portion 22 in a generally downwardly spiraling configuration is coin ramp 24. As shown more clearly in FIG. 8, a coin 40 may roll on its edge along ramp 24, and is guided on one side by the exterior surface of body portion 22 above the ramp, and on the other side by an upstanding ramp guidewall portion 26 on the body portion 22 below the ramp. Although the body portion 22 exterior surface is shown angled, it may be configured to be vertical so that the general cone shape configuration is formed by the outward spiraling of the ramp. The upper portion of ramp 24 is disposed to receive coin 40 as it drops from header 30 and begins its travel down the ramp. The slope of ramp 24 should be sufficient to permit the coin to roll by gravity along its entire length, and is determined by the height of the body 22, its diameter and the number of times it wraps around the body.

To provide further interactivity and engagement with the user, ramp 24 may include a staircase portion. As shown in more detail in FIG. 9, ramp steps 25 provide a bumping motion for the coin as it travels downward along the ramp. Also, at the lower end of ramp 24, there may be provided an upwardly extending portion 28, which functions to launch the coins 40 through the air as they reach the lower end of the ramp.

Figure 6:
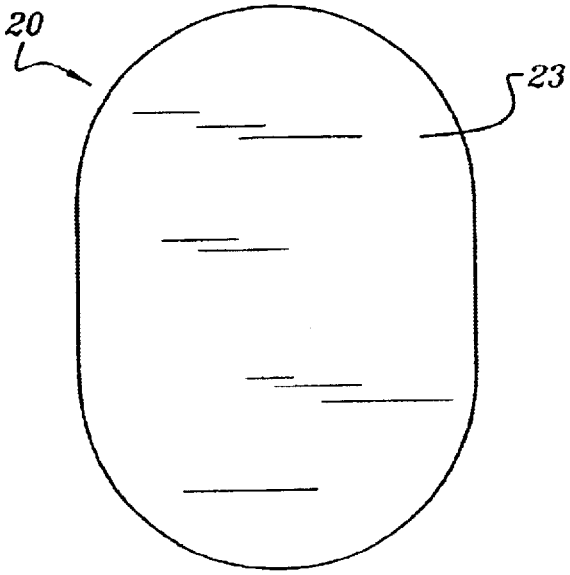
FIG. 6 is a bottom view of the device of FIG. 1.
Figure 7:
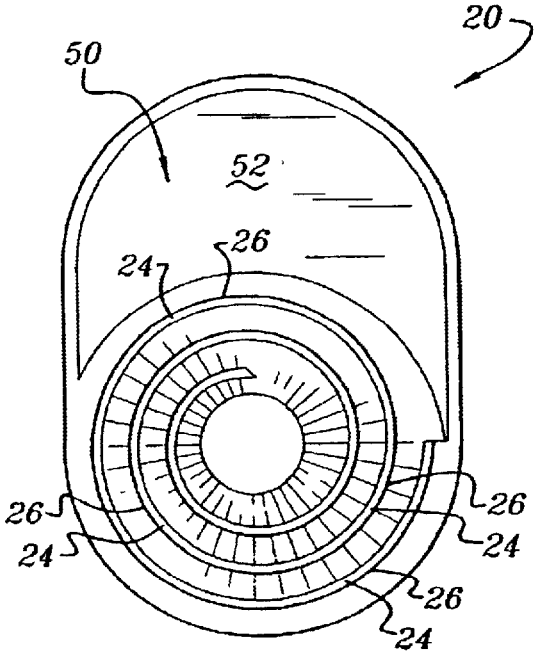
FIG. 7 is a top plan view, without the header portion, of the device of FIG. 1.
Figure 8:
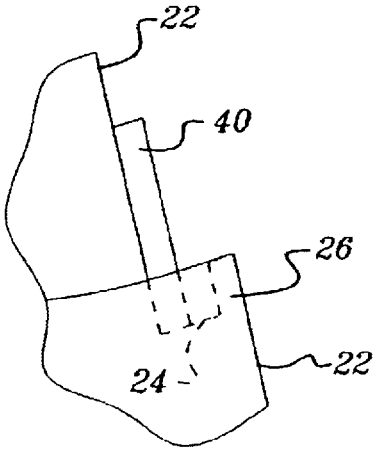
FIG. 8 is a close-up side elevational view, partially in phantom, of a portion of the device of FIG. 1 showing the coin and coin ramp.

After exiting the ramp, the coins are caught or received in an open coin tray portion 50, which extends outward from the lower part of body portion 22, and is configured for ready access by the user's hand to retrieve coins deposited therein. As shown in FIG. 6, the base of the device preferably has an oval or elliptoid configuration, although any other configuration may be utilized.

Since it is an object of the present invention to engage a customer for a relatively extended period of time as the coins travel down along the device, indicia may be incorporated into any of the visible surfaces of the device for advertising or promotional purposes. For example, the advertising indicia 38 may be incorporated into the face of the header portion (FIG. 4) but incorporation onto any other surface may be made, including the exterior of body portion 22 or coin tray 50.

Figures 9, 10, 11, 12:
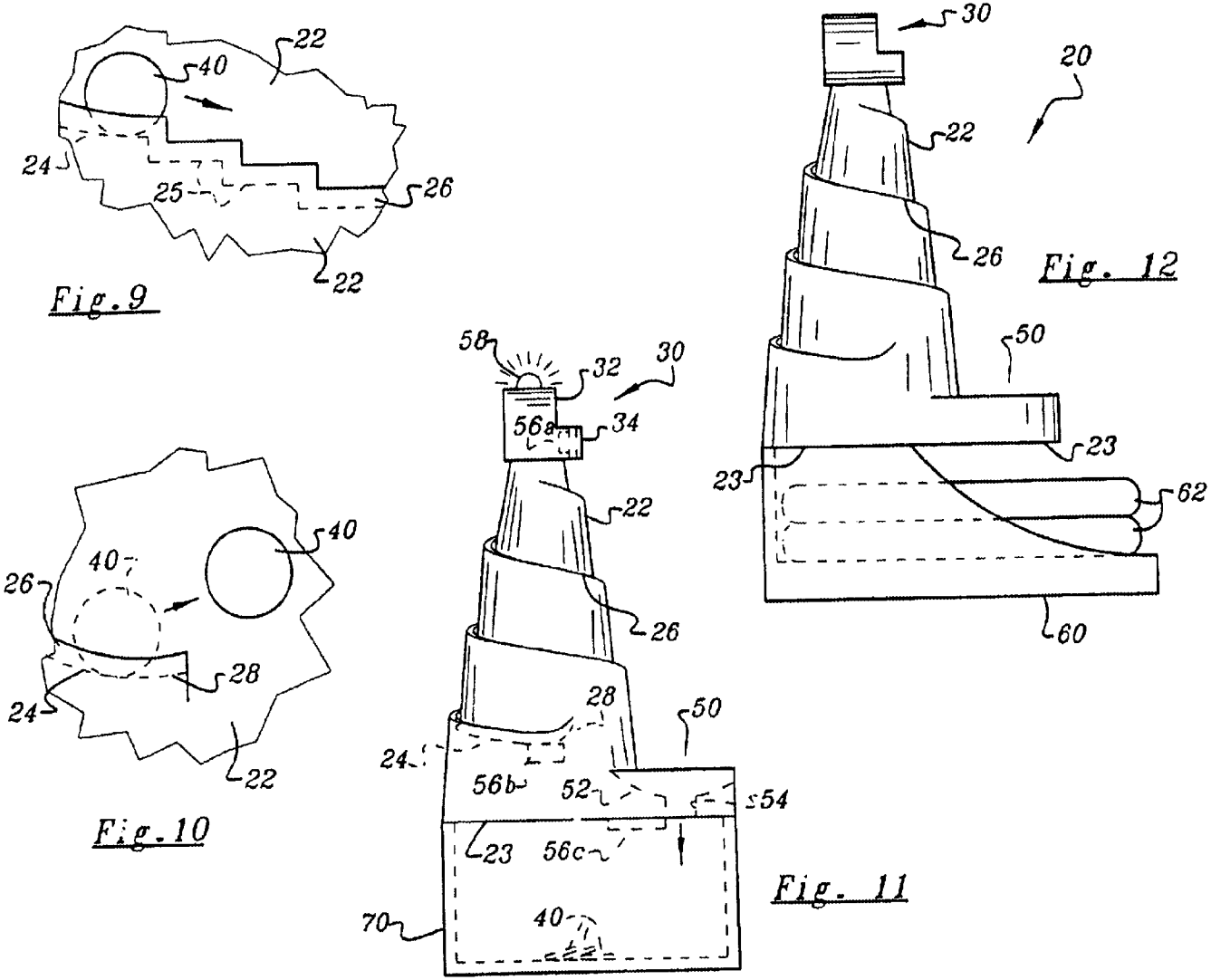
FIG. 9 is a close-up side elevational view, partially in phantom, of a portion of the device of FIG. 1 showing the staircase portion of the ramp.
FIG. 10 is a close-up side elevational view, partially in phantom, of the device of FIG. 1 showing the bottom portion of the ramp launching a coin.
FIG. 11 is a side elevational view, partially in phantom, of a modification of the device of FIG. 1 showing a coin bank below the device.
FIG. 12 is a side elevational view, partially in phantom, showing another modification of the device of FIG. 1 showing a storage rack below the device.

To provide further interactivity and engagement with the user, the device may incorporate sensors which react to the use of the coins and may trigger lights and or sounds from the device. As shown in FIG. 11, for example, a sensor 56*a* in header portion 30, or 56*b* along ramp 24 at the lower end thereof may be used to trigger a light or sound device 58. Any well known sensor may be utilized which is mechanically tripped by the coin or senses the metal in the coin as in a proximity sensor.

Also shown in FIG. 11, the present invention may be also utilized as a bank or other coin storage apparatus by including a coin receptacle 70 attached to the bottom 23 of the device. In this modification, the bottom 52 of coin tray 50 may be configured so as to slope downward to an open slot 54, which permits the coins to roll out of the coin tray and into receptacle 70. A coin sensor 56*c* may be disposed adjacent the coin tray opening 54 to trigger light or sound device 58 or some other device.

In the preferred mode of operation, a user deposits a coin by hand onto the header portion, and views the object as it rolls downwardly and singly by gravity on the ramp around the exterior of the body and then falls into the tray. Either that user or any other user may retrieve the coins by hand if needed.

As a further modification for POS use, FIG. 12 depicts a storage rack or tray 60 disposed beneath device 20. This rack 60 may store and display items for sale or distribution for example, candy 62, personal items, forms, coupons or the like. Storage rack 60 is preferably open on the top and more preferably also open on the sides to permit easy retrieval by hand of any items stored therein.

Thus the present invention achieves the objects described above and provides an interactive device for depositing and retrieving coins for use at a store POS which provides interactivity with the customer and engages the customer's attention for an extended time, and which may include advertising indicia and/or a product display and storage rack.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having decribed the invention, what is claimed is:

1. A device for depositing and retrieving coins or other disk-like objects comprising:

a generally conical-shaped, upstanding body having an exterior tapering to a larger diameter from top to bottom;

a header portion at the top of the body for depositing said objects;

a downwardly and outwardly spiraling ramp, below the header portion, extending at least once around the exterior of the body, along which the objects may roll downwardly by gravity; and a tray adjacent the bottom of the body for receiving the objects from the ramp.

2. The device of claim 1 wherein the ramp includes an upwardly extending portion at the lower end of the generally conical-shaped body for launching the objects through the air into the open tray.

3. The device of claim 1 further including a staircase portion on the spiraling ramp.

4. The device of claim 1 wherein the header portion comprises a slot having an open bottom from which the objects fall by gravity to the ramp near the top of the generally conical-shaped body.

5. The device of claim 1 wherein the header portion is adapted to receive the objects singly.

6. The device of claim 1 wherein the header portion has a surface against which the objects may be singly placed by hand, and an open slot below the surface through which the objects may fall onto the ramp after being released by the hand.

7. The device of claim 1 wherein the header portion includes a visible indicia on a surface thereof.

8. The device of claim 1 wherein the ramp is adjacent the exterior of the body and cooperates therewith to guide the objects as they roll downwardly by gravity.

9. The device of claim 1 wherein the ramp includes a lip for guiding the objects as they roll downwardly by gravity, the ramp and the lip being integral with and formed by the exterior of the body.

10. The device of claim 1 wherein the tray is disposed outward of the generally conical-shaped body.

11. The device of claim 1 wherein the tray is an open tray from which the objects may be readily retrieved by hand.

12. The device of claim 1 further including a storage rack disposed below the tray for displaying articles associated with the device.

13. The device of claim 1 wherein the tray includes a downwardly sloping portion and an opening at a lower end thereof, and further including a receptacle below the tray opening, whereby objects received in the tray may travel downward by gravity through the opening and into the receptacle.

14. The device of claim 1 further including a sensor for detecting when an object passes a position on the device.

15. A device for depositing and retrieving coins or other disk-like objects comprising:

a generally conical-shaped, upstanding body having an exterior tapering to a larger diameter from top to bottom;

a header portion at the top of the body for receiving said objects, the header portion including a slot having an open bottom from which the objects may fall singly by gravity after being deposited in the slot;

a downwardly and outwardly spiraling ramp, below the header portion and adjacent the exterior of the body, extending at least once around the exterior of the body, the ramp having a lip portion on an edge outward of the body exterior, the body exterior, ramp and lip portion cooperating to guide the objects as they roll downwardly by gravity the ramp includes a lip for guiding the objects as they roll downwardly by gravity around the exterior of the body; and an open tray disposed outward of and adjacent the bottom of the generally conical-shaped body for receiving the objects from the ramp.

16. The device of claim 15 wherein the ramp includes an upwardly extending portion at the lower end of the generally conical-shaped body for launching the objects through the air into the open tray.

17. The device of claim 15 wherein the header portion has a surface against which the objects may-be singly placed by hand, and an open slot below the surface through which the objects may fall onto the ramp after being released by the hand.

18. The device of claim 15 further including a storage rack disposed below the tray for displaying articles associated with the device.

19. The device of claim 15 wherein the tray includes a downwardly sloping portion and an opening at a lower end thereof, and further including a receptacle below the tray opening, whereby objects received in the tray may travel downward by gravity through the opening and into the receptacle.

20. A method for depositing and retrieving coins or other disk-like objects comprising:

providing a device having a generally conical-shaped, upstanding body with an exterior tapering to a larger diameter from top to bottom; a header portion at the top of the body for receiving said objects; a downwardly and outwardly spiraling ramp, below the header portion, extending at least once around the exterior of the body; and a tray adjacent the bottom of the body;

depositing an object by hand in the header portion;

viewing the object as it rolls downwardly by gravity on the ramp around the exterior of the body and falls into the tray; and retrieving the object by hand after it has fallen into the tray.

* * * * *